US005546765A

United States Patent [19]

Nagamura et al.

[11] Patent Number: 5,546,765

[45] Date of Patent: Aug. 20, 1996

[54] AIR SEPARATING UNIT

[75] Inventors: Takashi Nagamura; Shinji Tomita, both of Hyogo, Japan

[73] Assignee: L'Air Liquide, Societe Anonyme pour l'Etude et l'Exploitation des Procedes Georges Claude, Paris Cedex, France

[21] Appl. No.: 392,341

[22] Filed: Feb. 22, 1995

[30] Foreign Application Priority Data

Sep. 14, 1994 [JP] Japan ..... 6-220174

[51] Int. Cl.[6] ..... F25J 3/02

[52] U.S. Cl. ..... 62/643; 62/652; 62/901

[58] Field of Search ..... 62/13, 24, 31, 62/32, 33, 38, 39

[56] References Cited

U.S. PATENT DOCUMENTS

| | | | |
|---|---|---|---|
| 3,593,534 | 7/1971 | Seidel | 62/13 |
| 4,099,945 | 7/1978 | Skolaude | 62/38 X |
| 4,382,366 | 5/1983 | Gaumer | 62/39 X |
| 4,530,708 | 7/1985 | Nakazato et al. | 62/39 X |
| 4,560,397 | 12/1985 | Cheung | 62/28 |
| 4,595,405 | 6/1986 | Agrawal et al. | 62/33 X |
| 4,843,828 | 7/1989 | Gladman | 62/32 X |
| 4,867,773 | 9/1989 | Thorogood et al. | 62/39 |
| 5,079,923 | 1/1992 | Grenier | 62/24 X |
| 5,218,825 | 6/1993 | Agrawal | 62/24 X |
| 5,333,463 | 8/1994 | Garnier et al. | 62/33 X |
| 5,349,822 | 9/1994 | Nagamura et al. | 62/39 |
| 5,351,492 | 10/1994 | Agrawal et al. | 62/39 X |
| 5,425,241 | 6/1995 | Agrawal et al. | 62/24 X |

*Primary Examiner*—Christopher Kilner
*Attorney, Agent, or Firm*—Young & Thompson

[57] ABSTRACT

An air separating unit which can jointly produce high purity nitrogen gas and compressed dry air of high quality freed of hydrocarbons such as methane and ethane. The air separating unit is constructed such that compressed dry air freed of hydrogen, carbon monoxide, carbon dioxide and moisture is cooled down near to its liquefying point and introduced into a rectification column (30) and nitrogen gas separated by rectification from the compressed dry air in this rectification column (30) is taken out as a product. The rectifying portion in the rectification column (30) is divided into a lower rectifying portion (34) and an upper rectifying portion (36), and in this lower rectifying portion (34), hydrocarbons such as methane are mainly removed from the compressed dry air, and the compressed dry air which has passed through the lower rectifying portion (34) is taken out as a product.

6 Claims, 2 Drawing Sheets

AIR SEPARATING UNIT he present invention relates to an air separating process and unit for generating compressed dry air of high quality substantially free from hydrocarbons such as methane and ethane and high purity nitrogen gas.

PRIOR ART

Figure 2:
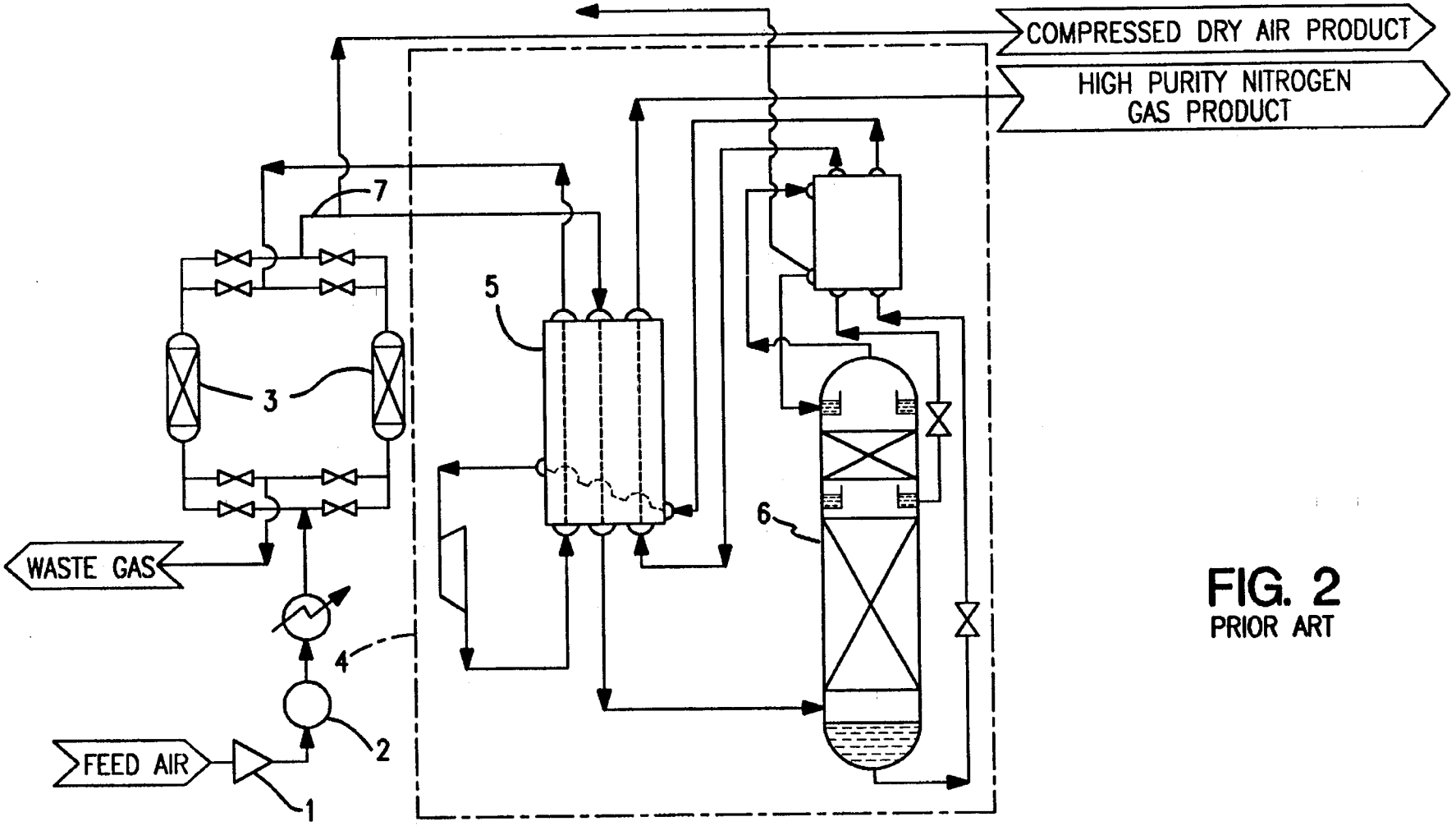
FIG. 2 PRIOR ART

In a semiconductor manufacturing factory or the like, an air separating unit for generation of nitrogen gas utilizing air as a feed material is often installed on site because a large amount of high purity nitrogen gas is used. Such air separating units of the type illustrated in FIG. 2 are well known. In the air separating unit shown in FIG. 2, feed air is first compressed by a compressor 1, and then passed through a catalyst column 2 and a decarbonating-drying column 3, thereby removing hydrogen, carbon monoxide, carbon dioxide and moisture from the feed air. Then this feed air is cooled down by heat exchange in a heat exchanger 5 disposed in a cold box 4, and rectified for separation in a rectification column 6 so as to provide high purity nitrogen gas. After this, high purity nitrogen gas is used as a cold source for cooling down the feed air fed to the heat exchanger 5, it is removed as a high purity nitrogen gas product at a normal temperature.

Moreover, in the semiconductor manufacturing factory, compressed dry air free from moisture and carbon dioxide is needed as well as high purity nitrogen gas. In the prior art, a part of the feed air passed through the decarbonating-drying column 3 is therefore led out of a pipe 7, and this is destined to be taken out as a compressed dry air product.

In a recent advanced semiconductor manufacturing apparatus, however, hydrocarbons such as methane and ethane still remaining in said compressed dry air product (having a total hydrocarbon a total content of 2,000 ppb–5,000 ppb) needed to be eliminated.

To overcome this problem, the present invention is constructed and intended to provide an air separating unit which can simultaneously generate high purity nitrogen gas and compressed dry air of high quality freed of methane and ethane.

In order to achieve the aforementioned purpose, according to the present invention, the air separating unit in which feed air taken from the atmosphere is cooled down near to its liquefying point by a heat exchanger, after it is compressed and freed of hydrogen, carbon monoxide, carbon dioxide and moisture, and the cooled feed air is introduced into a rectification column, nitrogen gas separated by rectification from the feed air in said rectification column is liquefied by condensation in a condenser, and liquid nitrogen liquefied by condensation in said condenser is introduced into the top portion of said rectification column as a reflux liquid, and a part of said reflux liquid is led out of said rectification column, thereby producing a nitrogen product, is characterized in that the rectifying portion in said rectification column is divided into a lower rectifying portion and an upper rectifying portion, and said lower rectifying portion is made to have such a minimum dimension of height as required for removing hydrocarbons such as methane and ethane from the feed air so that the total content of them is less than a predetermined value, wherein the feed air freed of the hydrocarbons is taken out as a compressed dry air product from a space between said lower rectifying portion and said upper rectifying portion.

The lower rectifying portion is effectively constructed so as to comprise one to five stages of rectifying plates. When the nitrogen product is taken out, furthermore, the part of the liquid nitrogen used as said reflux liquid is preferably led out of a rectifying plate positioned several stages below from the rectifying plate in the top portion of said rectification column so that high purity nitrogen gas produced from the liquid nitrogen freed of the low boiling point components is taken out.

Since hydrocarbons whose boiling points are higher than that of nitrogen or oxygen are removed from feed air in the lower rectifying portion of a rectification column, by virtue of the aforementioned construction, it is possible to take out compressed dry air of high quality which has a very small heavy impurity content from a space between the lower rectifying portion and upper rectifying portion thereof. Hydrocarbons, krypton and xenon are thereby removed for the feed air. The remaining part of the feed air which has not been taken out as a compressed dry air product is further caused to rise in the upper rectifying portion and it is separated by rectification to form high purity nitrogen gas.

Referring to the accompanying drawings, a preferred embodiment of the present invention will be described in detail.

Figure 1:
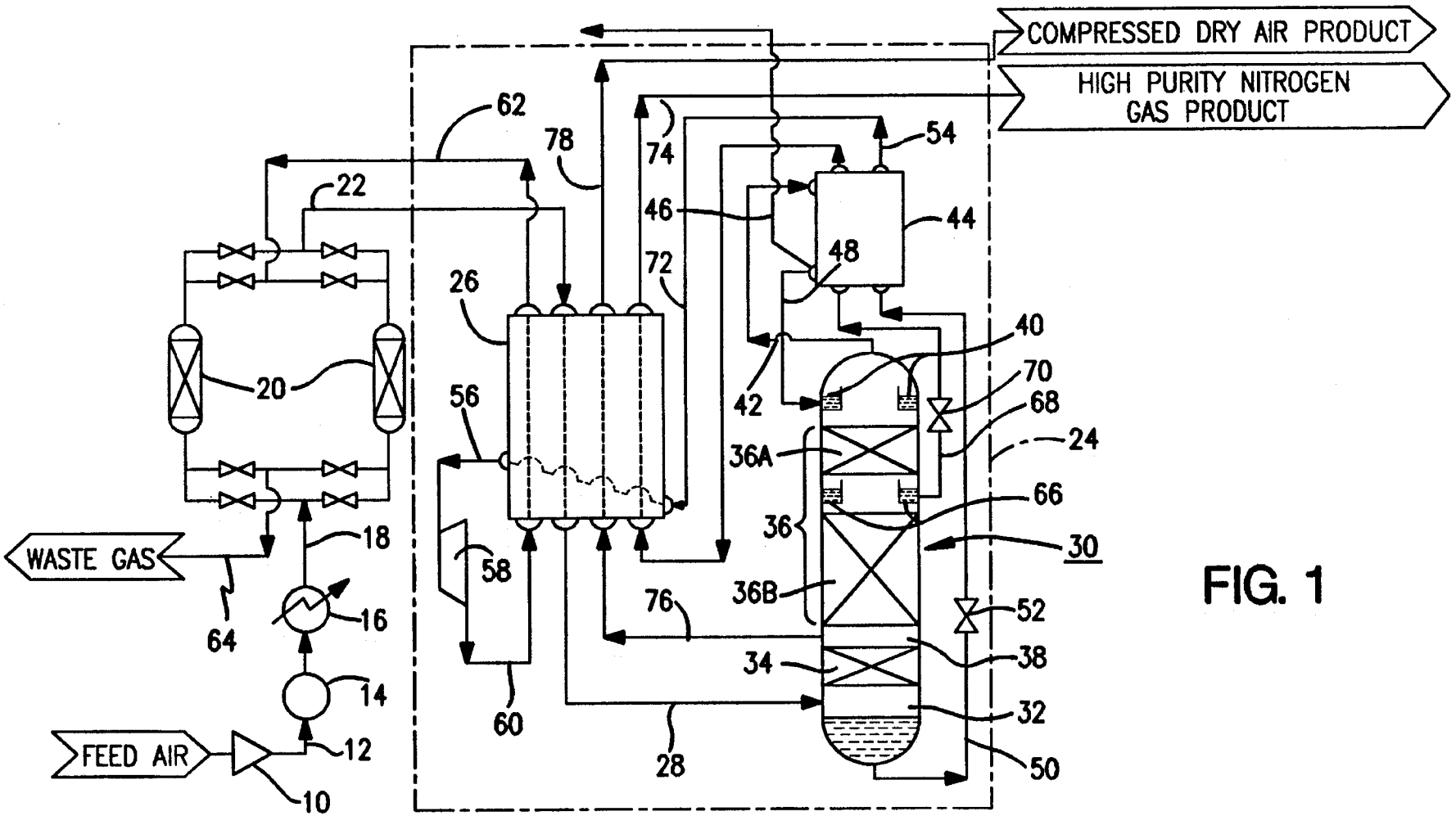

FIG. 1 is a flow diagram showing a preferred embodiment of the air separation plant, wherein, air is first freed from dust by an air filter (not shown); then as shown in the drawing, the air is introduced into a compressor 10 so as to be compressed to a pressure necessary for separation of air.

Then, the compressed feed air is introduced into a catalyst column 14 through a pipe 12. This catalyst column 14 is packed with an oxidation catalyst such as a palladium catalyst, and it is used in a high temperature state to oxidize carbon monoxide and hydrogen contained in the feed air so that they are converted to carbon dioxide and water, respectively.

Then the feed air is cooled down by a cooler 16, and thereafter introduced into a decarbonating-drying column 20 packed with alumina or molecular sieve by way of a pipe 18. This decarbonating-drying column 20 serves to remove the carbon dioxide and water in the feed air passed through the catalyst column 14.

Next, this feed air is introduced into a heat exchanger 26 disposed in a cold box (a thermally insulated vessel) 24 by way of a pipe 22, where it is cooled down near to its liquefying point by heat exchange with oxygen-enriched air, high purity nitrogen gas and compressed dry air, which will be hereinafter mentioned. The feed air flowing out of the heat exchanger 26 is introduced into a lower space 32 of a rectification column 30 at a predetermined pressure and temperature by way of a pipe 28. Under such pressure-temperature conditions, a part of the feed air introduced in the space 32 of the rectification column 30 is liquefied and collected as oxygen-enriched liquid air in the bottom portion of the rectification column 30 and the remaining part thereof is permitted to rise through the rectification column 30.

In the rectification column 30, there is provided a rectifying portion comprising several stages of rectifying plates. According to the present invention, this rectifying portion is composed of a lower rectifying portion 34 comprising several stages (specifically, one to five stages, and preferably two to three stages) of rectifying plates and an upper rectifying portion 36 comprising a plurality of stages of rectifying plates, with a space 38 formed between both of these rectifying portions. In this embodiment, in addition, the upper rectifying portion 36 is further divided into an upper part and a lower part, and this upper part of the upper rectifying portion comprises several stages of rectifying plates. For convenience, the upper part of the upper rectifying portion will be thereinafter called a first upper rectifying portion 36A and the lower part of the upper rectifying portion will be called a second upper rectifying portion 36B.

The feed air rising from the lower space 32 of the rectification column 30 is brought, in the rectifying portions, into gas-liquid contact in a countercurrent state with a reflux liquid flowing down from above. As a result, components whose boiling points are higher than that of nitrogen, such as oxygen contained in the feed air, are condensed by the liquid nitrogen, and the thus-condensed components are caused to flow down as oxygen-enriched liquid air, while the nitrogen purity of the feed air is being increased so as to become nitrogen gas, as it rises through the rectifying portions 34, 36.

Thus, the nitrogen gas which has passed through the rectifying portions 34, 36 and reached its column top portion, is taken out of the column top portion through a pipe 42 and introduced into a condenser 44, where it is cooled down. As a result, non-condensed gas consisting of low boiling point components such as concentrated helium, hydrogen and neon is purged from a pipe 46, and liquefied liquid nitrogen is returned to a liquid nitrogen reservoir 40 in the column top portion of the rectification column 30 through a pipe 48.

The oxygen-enriched liquid air collected in the column bottom portion of the rectification column 30 is taken out through a pipe 50. After the oxygen-enriched liquid air is expanded by means of an expansion value 52 so as to be further cooled down, it is introduced into the condenser 44, where it issued as a cold source. The oxygen enriched air evaporated in the condenser 44 is taken out through a pipe 54 and introduced into the heat exchanger 26, where it cools down the feed air, and then taken out through a pipe 56. Then, this oxygen enriched air is expanded by means of an expansion turbine 58 so as to be cooled down, and introduced into the heat exchanger 26 through a pipe 60 again, where it is used for cooling of the feed air. After the heat exchange, the oxygen-enriched air is sent to the decarbonating drying column 20 packed with alumina or molecular sieves and used as a regenerating gas therefor, and it is finally discharged as waste gas to the atmosphere through a pipe 64.

The liquid nitrogen returned to the liquid nitrogen reservoir 40 in the top portion of the rectification column 30 has become liquid nitrogen freed of the high boiling point components such as methane, ethane and oxygen and further freed of moisture and carbon dioxide. A part of this liquid nitrogen is caused to flow down toward the rectifying portions 36, 34 as the said reflux liquid as it is in a liquid state, and the remaining part thereof is caused, in order to increase its purity, to flow down through the first upper rectifying portion 36A as liquid nitrogen so as to be freed of helium, hydrogen and neon, and then taken out of a high purity liquid nitrogen reservoir 66 disposed between the first upper rectifying portion 36A and the second upper rectifying portion 36B through a pipe 68. After the high purity liquid nitrogen taken out through the pipe 68 is expanded by means of an expansion valve 70, it is introduced into the condenser 44, where it cools down and liquefies the nitrogen gas coming from the pipe 42. The high purity nitrogen gas evaporated by heat exchange in the condenser 44 is taken out through a pipe 72 and sent to the heat exchanger 26, where it is heat exchanged with the feed air so that its temperature becomes normal temperature, and then it is taken out as a high purity nitrogen gas product through a pipe 74.

By causing the liquid nitrogen collected in the liquid nitrogen reservoir 40 in the top portion of the rectification column 30 to flow down several rectifying plates and taking it out as liquid, it can be changed to be high purity liquid nitrogen in which the low boiling point components such as helium, hydrogen and neon are reduced to 2% of their original value or less, as compared with liquid nitrogen at a time when it is introduced from the pipe 38 into the rectification column 30.

In the rectification column 30, as shown in FIG. 1, a pipe 76 is connected so as to communicate with the space 38, where the feed air in the space 38, (a part of the compressed dry air), is taken out through this pipe 76 and introduced into the heat exchanger 26. This compressed dry air is also in heat exchange with the feed air coming from the decarbonating-drying column 20 packed with alumina or molecular sieves so that its temperature becomes normal temperature, and then it is taken out through a pipe 78 so as to supplied to a user as a compressed dry air product.

The boiling points of methane and ethane are about −161.5° C. and about −88.6° C. at 1 atm, respectively, and hence they are higher than the boiling points of nitrogen and oxygen which are respectively about 195.8° C. and about−183.0° C. at 1 atm. The boiling points of hydrocarbons whose molecular weights are higher than that of methane are also higher than the boiling point of methane. Even under the operation pressure at a time when the rectification column 30 of this air separating unit is operated, furthermore, this relation is never reversed. From the feed air rising through the rectification column 30, therefore, hydrocarbons such as methane and ethane are first removed. Thus, almost all of the hydrocarbons such as methane and ethane are remaining no longer in the feed air which has passed through the lower rectifying portion 34 and reached the space 38. The total amount of them is very slightly less than 1 ppb. As to the oxygen on the other hand, it is scarcely removed in the lower rectifying portion 34, and hence the feed air in the space 38 still contains oxygen at a ratio as high in normal air. In addition, the feed air introduced in the rectification column 30 has been already compressed by means of the compressor 10 and freed of hydrogen, carbon monoxide, carbon dioxide and moisture by the catalyst column 14 and by the decarbonating-drying column 20. Accordingly, the air taken out of the inside of the space 38 by way of a pipe the heat exchanger 26 and a pipe 78 becomes compressed dry air of high quality suitable for use in the manufacture of semiconductors.

Although the preferred embodiment of the present invention has been described, it goes without saying that the present invention is not limited to the aforementioned embodiment. Pot instance, the number of the stages of the rectifying plates in the lower rectifying portion 34 can be variously changed depending on the amount of hydrocarbons such as methane and ethane to be removed. Furthermore, the rectifying portions 34, 36 may be constructed, for example, as one filled with packing plates. Not illustrated in the drawings, moreover, high purity liquid nitrogen separately supplied may be introduced into the column top portion of the rectification column 30 as a cold source, with the expansion turbine omitted, and liquid nitrogen of another purity may be introduced to a stage which corresponds to that purity in the rectification column 30.

As has been mentioned above, it becomes possible, according to the present invention, to supply compressed dry air of higher quantity and nitrogen gas of higher purity.

Owing to the fact that the construction of the present invention is available only by modifying a conventional air separating unit slightly, it is possible to utilize an existing plant and hence to supply compressed dry air of high quantity and high purity nitrogen gas cheaply.

We claim:

1. In an air separating process in which feed air taken from the atmosphere is cooled down near to its liquefying point by a heat exchanger, after being compressed, and the cooled feed air is introduced into a rectification column, nitrogen gas is separated by rectification from the feed air in said rectification column and is liquefied by condensation in a condenser, and liquid nitrogen liquefied by condensation in said condenser is introduced into the top portion of said rectification column as a reflux liquid, and a part of said reflux liquid is led out of said rectification column, thereby producing a nitrogen product; the improvement wherein the rectifying portion in said rectification column comprises a lower rectifying portion and an upper rectifying portion, and said lower rectifying portion contains a sufficient number of theoretical stages to remove heavy impurities from the feed air so that the total impurity content is less than a predetermined value, and wherein the feed air substantially freed of the heavy impurities is removed from a space (38) between said lower rectifying portion and said upper rectifying portion and is removed from said process as a product gas.

2. The process as claimed in claim 1, in which said lower rectifying portion (34) comprises one to five real or theoretical stages.

3. The process as claimed in claim 1, in which part of the liquid nitrogen is removed at a point several stages below said top portion of said rectification column (30) so that high purity nitrogen gas produced from the liquid nitrogen is substantially free from low boiling point components.

4. An air separating unit comprising:

a distillation column, means for supplying feed air contaminated with heavy impurities to the distillation column at a point of introduction, means for withdrawing feed air substantially free from heavy impurities from a withdrawal point several theoretical or actual stages above said point of introduction, and means for removing the feed air substantially free from heavy impurities, from the unit as a product gas.

5. A unit as claimed in claim 4, wherein said withdrawal point is one to five theoretical stages above said point of introduction.

6. A unit as claimed in claim 4, wherein said withdrawal point is one to five actual stages above said point of introduction.

* * * * *